US007080632B2

(12) United States Patent
Kleppner et al.

(10) Patent No.: US 7,080,632 B2
(45) Date of Patent: Jul. 25, 2006

(54) APPARATUS FOR PUMPING FUEL

(75) Inventors: Stephan Kleppner, Bretten (DE); Hans-Peter Braun, Renfrizhausen (DE); Thomas Wieland, Stuttgart (DE); Ludger Kuermann, Schwieberdingen (DE); Winfried Eckart, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/155,685

(22) Filed: Jun. 20, 2005

(65) Prior Publication Data

US 2005/0279414 A1 Dec. 22, 2005

(30) Foreign Application Priority Data

Jun. 18, 2004 (DE) ..... 10 2004 029 527
Oct. 1, 2004 (DE) ..... 10 2004 047 782

(51) Int. Cl.
*F02M 37/10* (2006.01)
*F02M 37/04* (2006.01)

(52) U.S. Cl. ..... 123/509; 137/599.01

(58) Field of Classification Search ..... 123/509, 123/514, 495; 137/565.22, 599.01, 890, 137/574, 599.03

See application file for complete search history.

(56) References Cited

U.S. PATENT DOCUMENTS

| | | | | |
|---|---|---|---|---|
| 3,255,708 | A * | 6/1966 | Williams | 417/176 |
| 5,133,324 | A * | 7/1992 | Michiaki | 123/514 |
| 5,396,872 | A * | 3/1995 | Ruger et al. | 123/514 |
| 6,505,644 | B1 * | 1/2003 | Coha et al. | 137/565.22 |
| 6,832,627 | B1 * | 12/2004 | Braun et al. | 137/565.22 |
| 6,899,188 | B1 * | 5/2005 | Hughes et al. | 175/57 |
| 2002/0083983 | A1 | 7/2002 | Coha et al. | |

FOREIGN PATENT DOCUMENTS

| | | | |
|---|---|---|---|
| DE | 42 19 516 | A1 | 12/1993 |
| DE | 195 30 423 | A1 | 2/1997 |
| DE | 198 05 072 | A1 | 8/1999 |
| SU | 1218053 | * | 3/1986 |

* cited by examiner

*Primary Examiner*—Mahmoud Gimie
(74) *Attorney, Agent, or Firm*—Ronald E. Greigg

(57) ABSTRACT

Known apparatuses for pumping fuel have at least two suction jet pumps, which each have one drive nozzle and one collection conduit and mixing conduit located downstream of the drive nozzle. A disadvantage is that the parallel suction jet pumps require a large amount of installation space, are embodied very massively, and therefore require a large amount of injection-molding compound for their manufacture. In the apparatus of the invention, the production costs and the required installation space for the suction jet pumps are reduced. According to the invention, the drive nozzles are surrounded by a single collection conduit, narrowing conically in the flow direction and located upstream of the mixing conduits.

9 Claims, 2 Drawing Sheets

APPARATUS FOR PUMPING FUEL

CROSS-REFERENCE TO RELATED APPLICATIONS

This application is based on German Patent Applications 10 2004 029 527.1 filed Jun. 18, 2004 and 10 2004 047 782.5 filed Oct. 1, 2004, upon which priority is claimed.

BACKGROUND OF THE INVENTION

1. Field of the Invention

The invention is directed to an improved fuel pumping apparatus, and more particularly to such an apparatus for pumping fuel to an internal combustion engine.

2. Description of the Prior Art

An apparatus for pumping fuel known from German patent Disclosure DE 42 19 516 A1, has at least two suction jet pumps, which each have one drive nozzle and one collection conduit and mixing conduit located downstream of the drive nozzle.

Apparatuses for pumping fuel with a single suction jet pump, as shown for instance in German Patent DE 43 38 504 C2, have the disadvantage that the pumping capacity of the suction jet pump, under certain operating conditions, is insufficient to supply a feed pump, located in a reservoir, with enough fuel.

OBJECT AND SUMMARY OF THE INVENTION

The apparatus for pumping fuel according to the invention has the advantage over the prior art that in a simple way, an improvement is attained such that the production costs are reduced by providing that the drive nozzles are surrounded by a single collection conduit, narrowing conically in the flow direction and located upstream of the mixing conduits. In this way, the suction jet pumps are more compactly constructed and can be manufactured with less injection-molding compound.

Other advantageous refinements of and improvements to the apparatus defined by the main claim are disclosed. It is especially advantageous if between the drive nozzles and the collection conduit, an annular gap is provided, which is in communication upstream with an intake conduit. In this way, the aspirated fuel flows virtually parallel to the propellant streams into the collection conduit, so that a deflection of the propellant streams transversely to the flow direction is avoided.

It is also advantageous if the collection conduit defines an intake chamber and directs the fuel out of the intake chamber into the mixing conduits, since the propellant streams generate an underpressure in the intake chamber and in this way aspirate fuel into the intake chamber via the intake conduit. The aspirated fuel is entrained by the propellant streams into the mixing conduits.

It is also advantageous if the drive nozzles are joined integrally to one another, since this makes for especially favorable manufacture of the suction jet pumps.

It is also advantageous if as well, the mixing conduits are joined integrally to one another, since in this way the production costs of the suction jet pumps are reduced markedly.

It is furthermore advantageous if the mixing conduits are separated from one another by means of a partition, because this is required to maintain a high pumping capacity of the suction jet pumps.

It is furthermore advantageous if the mixing conduits discharge downstream into a common diffusor, since in this way pressure energy is recovered, and flow noises are reduced.

It is highly advantageous if the cross section of the diffusor is embodied in the form of a FIG. 8, because in this way the suction jet pumps can be located very close together and as a result require especially little installation space. Moreover, in this way, only little injection-molding compound is needed, so that the production costs are reduced.

In an especially advantageous exemplary embodiment, each drive nozzle is associated with one of the mixing conduits, and the drive nozzles are located concentrically with respect to the associated mixing conduit.

BRIEF DESCRIPTION OF THE DRAWINGS

The invention will be better understood and further objects and advantages thereof will become more apparent from the ensuing detailed description of a preferred embodiment taken in conjunction with the drawings, in which.

DESCRIPTION OF THE PREFERRED EMBODIMENT

Figure 1:
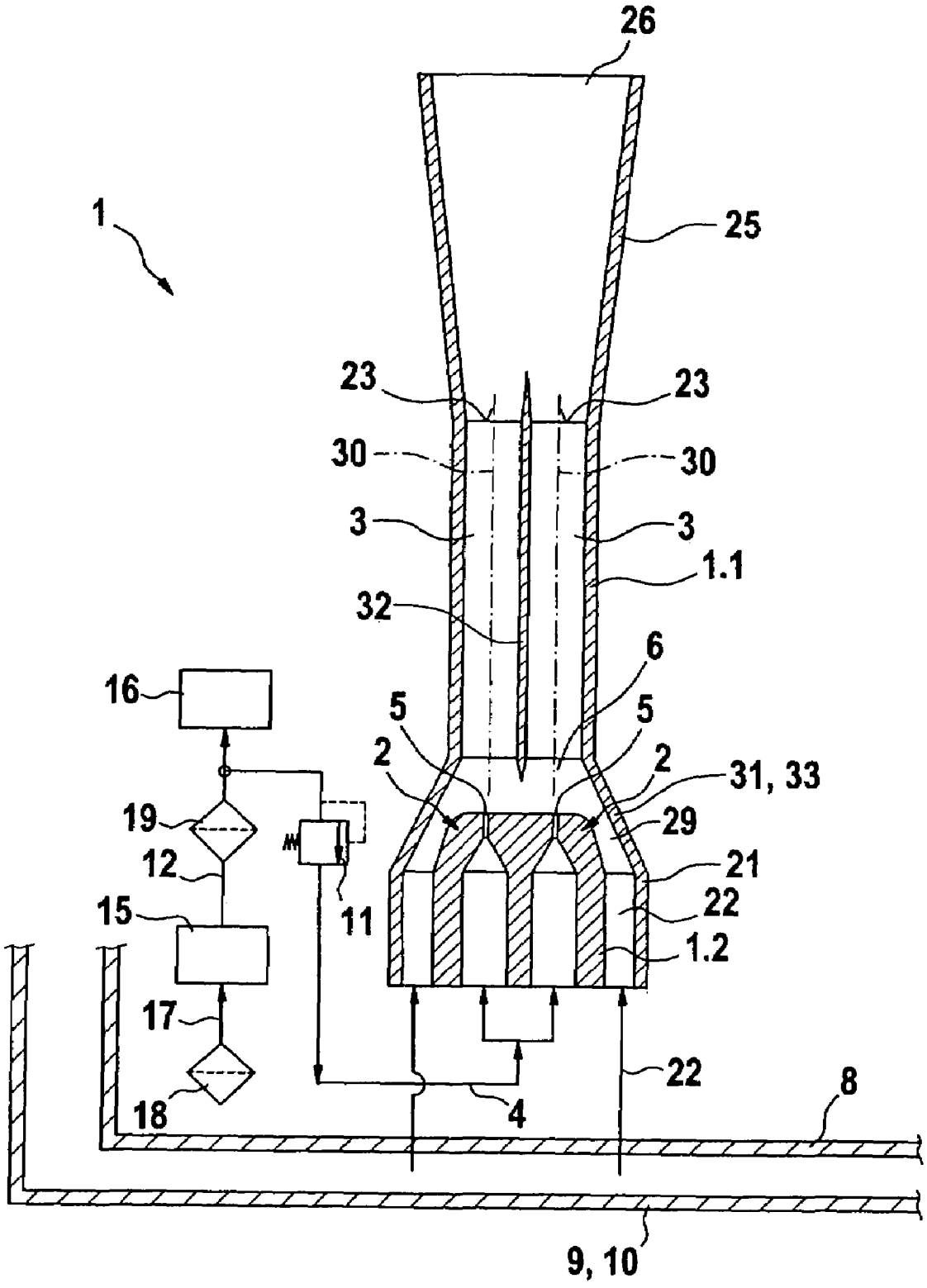
FIG. 1 is a sectional view, in elevation, of an apparatus for pumping fuel having two suction jet pumps according to the invention.

As shown in FIG. 1, the apparatus of the invention has a plurality of suction jet pumps 1, each with one drive nozzle 2 and one mixing conduit 3. The suction jet pumps 1 are provided for instance in a common housing 1.1, which is made for instance from plastic and by means of injection molding. As an example, two suction jet pumps 1 are embodied on the housing 1.1. However, it is expressly possible for there to be more than two suction jet pumps 1 integrated with the housing 1.1.

The drive nozzles 2 are embodied for instance as a nozzle-like constriction. The drive nozzles 2 communicate upstream with a propellant line 4 and downstream with a common intake chamber 6. Via the propellant line 4, each drive nozzle 2 is supplied with fuel, which reaches the intake chamber 6 in the form of a propellant stream, via one nozzle opening 5 each. The mixing conduits 3 are located downstream of the intake chamber 6.

The housing 1.1 with the suction jet pumps 1 is located for instance in a reservoir 8. The suction jet pumps 1 pump fuel from a tank 9 into the reservoir 8. The reservoir 8 is located inside the tank 9, for instance near the bottom 10 of the tank 9.

The mixing conduits 3 extend for instance in a direction generally parallel the tank bottom 10, which is also called a horizontal arrangement of the suction jet pumps 1. An arrangement of the mixing conduits 3 that is perpendicular or can also be called upright relative to the tank bottom 10, however, is equally possible.

The propellant line 4 communicates, for instance via a pressure regulating valve 11, with a pressure line 12, which begins at a pump unit 15 and extends to an internal combustion engine 16 and supplies it with fuel. The pump unit 15 is located for instance in the reservoir 8 and aspirates fuel via an intake line 17, in which a prefilter 18 is for instance provided, and pumps it, with its pressure elevated, via the pressure line 12 to the engine 16. A main filter 19, which filters out fine dirt particles from the fuel, is provided in the pressure line 12. From the pressure line 12, for instance downstream of the main filter 19, the propellant line 4 branches off and supplies the suction jet pumps 1 with fuel when the pressure regulating valve 11 is open. The pressure regulating valve 11 opens if the pressure in the pressure line 12 exceeds a predetermined value, and it causes excess fuel from the pressure line 12 to flow via the propellant line 4 and the drive nozzles 2 into the intake chamber 6 and back into the reservoir 8 via the mixing conduits 3 of the suction jet pumps 1. However, it is also expressly possible for the suction jet pumps 1 to be supplied via a return line, which pumps excess fuel back from the engine 16 into the tank 9. The suction jet pump 1 may communicate directly with the pressure line 12 either upstream or downstream of the main filter 19; the pressure of the pressure line 12 is lowered for instance by means of a throttle.

The suction jet pumps 1 aspirate fuel in a known manner from the tank 9, and via an intake conduit 22, the fuel reaches the intake chamber 6 of the suction jet pumps 1. The intake conduit 22 is formed for instance by an intermediate chamber between a hollow cylinder 21 of the housing 1.1 and the portions of the propellant line 4 that are located in the hollow cylinder 21 and branch off to the drive nozzles 2. The fuel flowing in the intake conduit 22 in the direction of the intake chamber 6 bypasses the portions of the propellant line 4 that branch off to the drive nozzles 2 and also bypasses the drive nozzles 2 themselves and passes through an annular gap 29, between a wall of the housing 1.1 and the drive nozzles 2, virtually parallel to the propellant streams to enter the intake chamber 6, so that the flow forces that deflect the propellant streams in the radial direction are only slight. In this way, the propellant streams of the drive nozzles 2 are prevented from pressing radially against a wall of the mixing conduits 3 and reducing the pumping capacity of the suction jet pumps.

The fuel in the propellant line 4, via the nozzle openings 5 in the drive nozzles 2, reaches the intake chamber 6 in the form of a so-called propellant stream, and the propellant streams, beginning at the drive nozzles 2, pass through the intake chamber 6 and each extend into one of the mixing conduits 3 that adjoin the intake chamber 6. Each propellant stream of one of the drive nozzles 2 entrains fuel out of the intake chamber 6 into the mixing conduit 3 associated with the drive nozzle 2, creating an underpressure in the intake chamber 6 that causes fuel to flow out of the tank 9 via the intake conduit 22 into the intake chamber 6 to replenish it. The fuel in the propellant streams and the entrained fuel in the intake chamber 6 and/or the mixing conduits 3 flow, via the mixing conduits 3 and a respective outlet opening 23 of the mixing conduit 3, for instance into a common diffusor 25, which discharges into the reservoir 8 via a diffusor outlet 26. By definition, the diffusor 25 widens in the flow direction, so that both the flow speed of the fuel and the flow noises are reduced. However, it is understood that the mixing conduits 3 may lead directly into the reservoir 8 instead.

The mixing conduits 3 are located side by side, and each has a conduit axis 30. The conduit axes 30 of the mixing conduits 3 each extend in the same direction and are for instance parallel to one another. One drive nozzle 2 is assigned to each mixing conduit 3. The mixing conduits 3 and the drive nozzles 2 are for instance concentric to one another, so that the propellant stream emerging from the drive nozzle 2 reaches the associated mixing conduit 3 and is ideally aligned with the conduit axis 30 of the associated mixing conduit 3.

According to the invention, the drive nozzles 2 are surrounded by a single collection conduit 31, which narrows conically in the flow direction and is located upstream of the mixing conduits 3. The collection conduit 31 is formed by a hollow cone 33, for instance, which adjoins the hollow cylinder 21 of the housing 1.1 in the flow direction. The collection conduit 31 defines the intake chamber 6 in the radial direction transversely to the flow direction and directs the fuel of the propellant streams and the entrained fuel out of the intake chamber 6 into the mixing conduits 3.

The drive nozzle 2 that belongs to each suction jet pump 1 is connected mechanically to the associated mixing conduit 3 via the collection conduit 31, for instance by means of webs, not shown. For instance, the drive nozzles 2 and/or the collection conduit 31 and/or the mixing conduits 3 are integrally joined to one another and are accordingly produced from only a single piece.

The drive nozzles 2 are located in the collection conduit 31. They are for instance joined integrally to one another and are provided in a common nozzle housing 1.2. The nozzle housing 1.2 is for instance part of the housing 1.1.

The mixing conduits 3 are also for instance joined integrally to one another and embodied on the housing 1.1. As a result, the suction jet pumps 1 can be manufactured especially simply and economically.

The mixing conduits 3 each have a generally circular flow cross section, for instance, and are separated from one another for instance by means of a partition 32. Because of the separation of the mixing conduits 3, the propellant streams cannot influence on one another. The partition 32 extends, for instance from the end toward the intake chamber 6 in the direction of the conduit axes 30 to the end of the mixing conduits 3 oriented toward the diffusor 25, and it can protrude on both ends into the intake chamber 6 and the diffusor 25, respectively. Since the partition 32 ends in the region of the outlet openings 23 of the mixing conduits, the mixing conduits 3 discharge into a single conduit that forms the diffusor 25. The partition 32 is embodied as a common mixing conduit wall for each two adjacent mixing conduits 3 and is for instance embodied in curved form.

Figure 2:
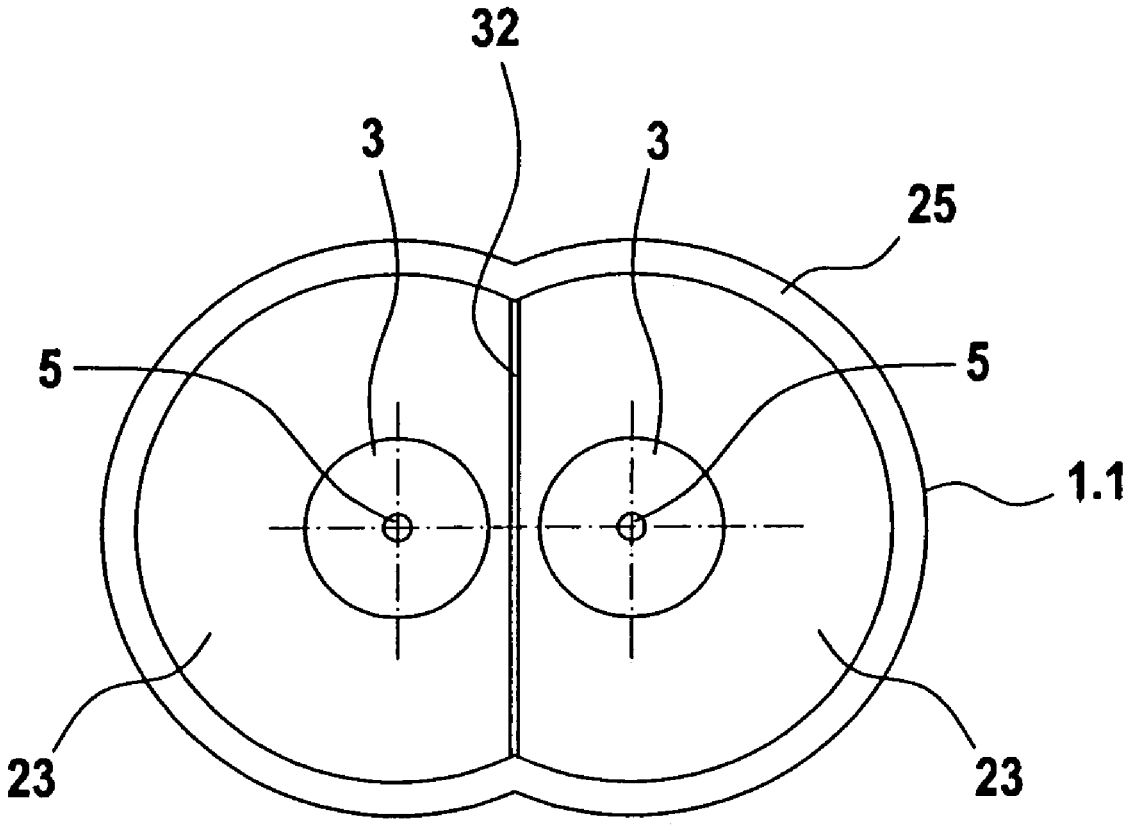
FIG. 2, in plan view, shows the two suction jet pumps of the invention of FIG. 1.

If for instance there are two suction jet pumps 1 embodied on the housing 1.1, then a cross section of the diffusor 25 in the form of a figure 8 is for instance provided (FIG. 2). In this way, the mixing conduits 3 are located very close together and in a way that economizes on installation space.

For instance, the intake conduit 22 is cylindrical, the collection conduit 31 is conical, the mixing conduits 3 are cylindrical, and the common diffusor 25 is conical.

The foregoing relates to a preferred exemplary embodiment of the invention, it being understood that other variants and embodiments thereof are possible within the spirit and scope of the invention, the latter being defined by the appended claims.

We claim:

1. An apparatus for pumping fuel, the apparatus comprising at least two suction jet pumps for pumping fuel from a fuel tank (9) into a reservoir (8), each jet pump having one drive nozzle, a mixing conduit located downstream of the drive nozzle, and a single collection conduit (31) surrounding the drive nozzles (2), the collection conduit (31) being located upstream of the mixing conduits (3) and narrowing conically in the flow direction.

2. The apparatus as recited in claim 1, further comprising a single annular gap (29) between the drive nozzles (2) and the collection conduit (31), and an intake conduit (22), the annular gap (29) being in communication with the intake conduit (22).

3. The apparatus as recited in claim 2, wherein the collection conduit (31) defines an intake chamber (6) and directs the fuel out of the intake chamber (6) into the mixing conduits (3).

4. The apparatus as recited in claim 1, wherein the drive nozzles (2) are joined integrally to one another.

5. The apparatus as recited in claim 1, wherein the mixing conduits (3) are joined integrally to one another.

6. The apparatus as recited in claim 1, wherein the mixing conduits (3) are separated from one another by means of a single partition (32).

7. The apparatus as recited in claim 1, wherein the mixing conduits (3) discharge downstream into a common diffusor (25).

8. The apparatus as recited in claim 7, wherein the cross section of the diffusor (25) is embodied in the general form of a figure 8.

9. The apparatus as recited in claim 1, wherein each drive nozzle (2) is associated with one of the mixing conduits (3), and wherein the drive nozzles (2) are located concentrically with respect to the associated mixing conduit (3).

* * * * *